United States Patent [19]

Ware

[11] 4,443,022

[45] Apr. 17, 1984

[54] ROLLER SKATE

[75] Inventor: Gordon K. Ware, Chicago, Ill.

[73] Assignee: The Chicago Roller Skate Company, Chicago, Ill.

[21] Appl. No.: 303,902

[22] Filed: Sep. 21, 1981

[51] Int. Cl.[3] ..... A63C 17/02

[52] U.S. Cl. ..... 280/11.28

[58] Field of Search ..... 280/11.19, 11.22, 11.23, 280/11.3, 11.27, 11.28

[56] References Cited

U.S. PATENT DOCUMENTS

| | | | |
|---|---|---|---|
| 1,294,984 | 2/1919 | Ware | 280/11.19 |
| 2,719,723 | 10/1955 | Ware | 280/11.2 |
| 2,719,725 | 10/1955 | Ware | 280/11.28 |
| 2,744,759 | 5/1956 | Sternbergh | 280/11.2 |
| 3,180,651 | 8/1962 | Ware | 280/11.2 |
| 3,862,763 | 1/1975 | Ware | 280/11.28 |
| 4,058,323 | 11/1977 | Ware, Jr. | 280/11.28 |
| 4,103,917 | 8/1978 | Widolf | 280/11.28 |
| 4,332,394 | 6/1982 | Klawitter | 280/11.19 |
| 4,357,028 | 11/1982 | Hsieh | 280/11.28 |

*Primary Examiner*—David M. Mitchell

*Attorney, Agent, or Firm*—Trexler, Bushnell & Wolters, Ltd.

[57] ABSTRACT

A unitary roller skate sole plate is provided with downwardly open recesses for receiving the strut arms of attached wheel trucks. The recesses include shaped, resilient cushions having sockets for holding the strut arms ends while allowing generally universal motion thereof.

8 Claims, 4 Drawing Figures

ROLLER SKATE

BACKGROUND OF THE INVENTION

This invention relates to roller skates and a wheel support assembly therefor, particularly for rink type roller skates, and to an improved sole plate of relatively low cost, light weight and enhanced durability.

Roller skates of this general type are shown in U.S. Pat. No. 1,294,984 with an action screw cushion and ball and socket strut arm mounting and U.S. Pat. No. 2,719,725 for a double action screw cushion and spring strut arm; in U.S. Pat. No. 2,719,723 with double action screw cushion and ball and socket connection for the strut arm, nd toe stop; in U.S. Pat. No. 3,180,651 for a sole plate included a threaded member for mounting a toe stop; in U.S. Pat. No. 3,862,763 for a cup-like cushion for the end of the strut arm. The above patents include a sole plate to which a heeled shoe is to be mounted. U.S. Pat. No. 4,058,323 shows a somewhat skeletal form of sole plate design for low cost, light weight and good durability. In a skatboard truck, another form of cushion mounting for the end of a strut arm is shown in U.S. Pat. No. 4,103,917.

In roller skate patents as above exemplified, the truck assemblies permit a degree of relative movement between the wheel axles and the sole plate for the skater to gracefully perform certain motions or steps but without a feeling of looseness between the parts as skating pressures are varied in a controlled manner.

SUMMARY OF THE INVENTION

According to the present invention, the action, or flexibility without looseness, as provided by the action screw cushions, is improved by the resilient mounting of the end of the strut arm in a cushion shaped with objective of permitting generally universal action therebetween with a reduced tendency of wear or pinching of the cushion during such action, and of providing for ready assembly of the cushion in a generally symmetrically shaped recess with an enlarged downwardly open end.

The invention further provides a somewhat skeletal form of unitary sole plate with an upwardly open recess defined by a peripheral wall with diagonal arrays of reinforcing ribs arranged for strengthening the sole plate particularly in the regions of upwardly open recesses mounting the securing devices for the action screws and the stop against rotation, and with the upper edges of the peripheral wall and ribs contoured along the length of the sole plate to provide heel, instep and toe portions for attachment of a shoe without the usual heel.

The above and other objects of the invention will be pointed out more fully in the following detail description of the drawings in which.

Figure 1:
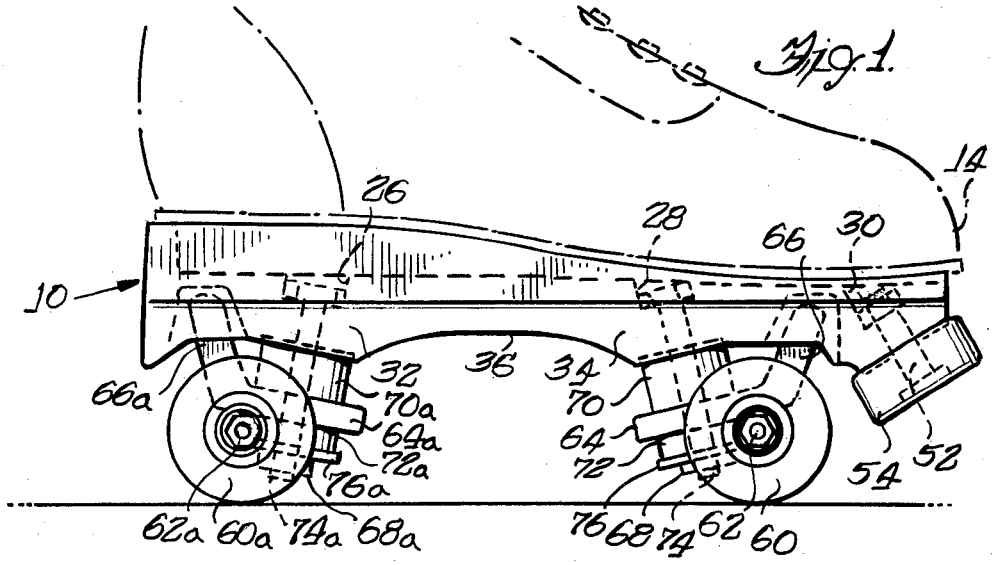
FIG. 1 is a side elevation of a roller skate with a portion of the shoe shown in broken lines.
Figure 2:
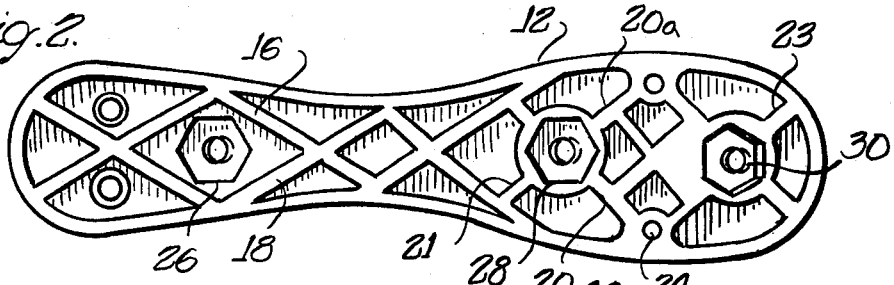
FIG. 2 is a top plan view of the sole plate.
Figure 3:
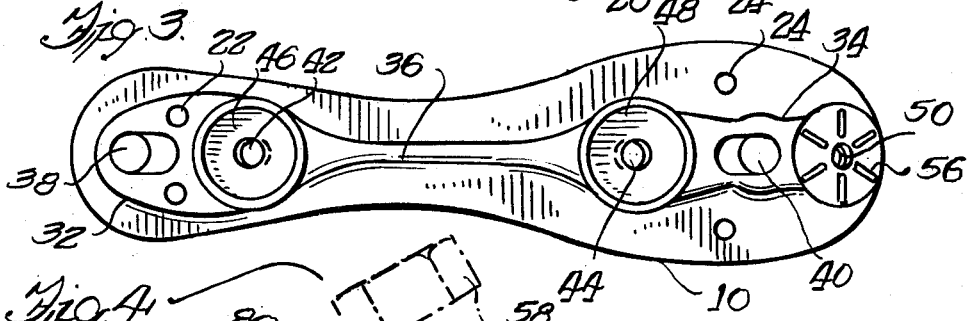
FIG. 3 is a bottom plan view of the sole plate.
Figure 4:
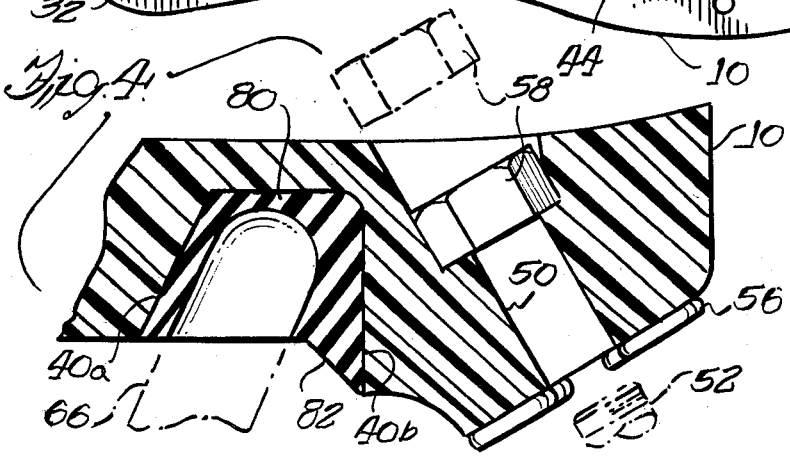
FIG. 4 is an enlarged fragmentary vertical section showing the strut arm and toe stop mounting along the toe portion of the sole plate.

In reference to the drawings and particularly FIGS. 1, 2 and 3 at this time, the sole plate 10 is die cast or molded from a suitable metal alloy or tough resilient plastic material and is recessed on the upper surface as defined by an upstanding peripheral wall 12 with the upper edge thereof contoured to present heel, instep and toe portions for attachment of a shoe 14 which thus need not be provided with a separate heel portion. Reinforcing ribs 16, 18 extend in diagonal crossing patterns between the inner surfaces of the peripheral wall 12 throughout the heel and instep portions, with additional rib diagonal patterns 20 at the toe portion. The tops of the rib patterns coincide with the surface contour of the top of the peripheral wall for shoe accomodation. The shoe is to be attached to the sole plate by rivets or the like through accomodating heel holes 22 and toe holes 24. The upper surface of the sole plate 10 is provided with hexagonal, or other cut-of-round upwardly open recesses to accomodate similarly shaped bolt heads or nuts, as the case may be, such as recess 26 for the rear action screw, recess 28 for the front action screw, and recess 30 for the toe stop mounting. The diagonal ribs 16, 18 serve to strengthen the sole plate and peripheral wall along the heel portion, including the action screw attaching area, and the instep portion. The additional array of ribs along the toe portion, such as **20*a*, 21, etc. serve to strengthen the area of attachment of the front action screw where the primary action is involved during use; and the ribs 23 serve to strengthen the toe stop attachment area where there is often violent action during use. The underside of the sole plate includes depending embossments 32 along the heel portion and 34 along the toe portion, these being connected by a depending rib portion 36 therebetween along the instep portion. The rear embossment 32 is provided with a downwardly open recess 38 near the rear end shaped for the mounting therein of a somewhat similarly shaped cushion for the rear action strut arm as will be hereinafter described. Similarly, the front embossment is provided with a shaped recess 40 in somewhat reverse positioning to the recess 38 for front action strut arm. Inclined apertures 42 in the rear embossment, communicate with the hexagonal recesses 26, 28, respectively, to receive therethrough the rear and front action screws of the rear and front trucks as will appear below. A shallow downwardly open recess 46 in the rear embossment around the aperture 42 provides a socket recess for the action screw cushion, as does recess 48 around the aperture 44, as will appear below. Similarly, an aperture 50 at the forward end of the sole plate is to receive the stem of a toe stop mounting element 52 by which a toe stop 54 is mounted against an array of radial ribs 56 therearound. An hexagonal nut 58, or the similar head of mounting element 52 as a bolt, is press fitted in the complementary shaped recess 30, or encapsulated therein during formation (molding) of the sole plate. As illustrated in FIGS. 1 and 4, the nut 58 is captured in the recess for receiving the threaded stem of bolt 52, but if the bolt head is captured in the recess, the nut will be assembled to the opposite threaded end thereof for securing the toe stop 54** which, in either case, can be readily removed for replacement.

The front and rear wheel or roller trucks for the roller skate are substantially identical but in reversed positioning of parts and the front truck assembly will be described with lettered suffix numerals applied to the rear truck assembly. The front truck wheels 60 are carried by an axle 62 which also carries an integral platform 64 and action strut arm 66 angularly disposed relative to one another. The front action screw 68 is illustrated as a headed bolt with the hexagonal drive head thereof press fitted or otherwise secured in the complementary shaped recess 28 and with the threaded shank thereof passing through upper and lower cushioning washer blocks 70, 72, respectively, of rubber or similar cushioning material. These cushioning blocks are disposed on opposite sides of the platform 64 through which the action screw 68 extends and is secured by a self-locking nut 74 operating against a washer 76. The upper surface of the upper cushion block 70 is seated in the recess 48 of the embossment 34. With this arrangement, the headed bolt may be assembled with the sole plate prior to attachment of the shoe. On the other hand, it is contemplated that a nut alone may be so assembled with the sole plate and the headed bolt then passed upwardly through the platform and cushion blocks for attachment to the previously press fitted or otherwise assembled nut.

As shown more in detail in FIG. 4, the recess 40 (the recess 38 is similar but reversed) opens downwardly with a larger opening than the upper closed end thereof. The configuration is such that there are no "undercut" surfaces so as to facilitate molding. As illustrated, this enlargement of the open end of the recess is elongated along the sole plate axis and includes opposite side walls and a rear wall 40*a* which is inclined symmetrically with respect to the longitudinal axis of the associated strut arm 66 in normal assembly. The forward wall 40*b* of the recess is generally vertical with respect to the horizontal plane of the sole plate and extends downwardly below the recess rear wall. This recess has mounted therein a cushioning socket member 80 of rubber or similar resilient material for complemental snug fit and mounting by a press fit, or augmented by adhesive bond, within the inner surface confines of the recess and with itself internally recessed for snug complemental fit with the rounded end of the strut arm 66 to provide a cushioned substantially universal connection in the nature of a ball and socket connection. The forward remnant portion of the cushion extends forwardly and downwardly, as at 82, to the bottom of the recess wall 40*b*, thus leaving a rather substantial thickness of cushion material in this area to enhance the "feel" of the skate during use and particularly under energetic action by the skater as in rink skating for indoor and dance or figure skating. In such use, it is particularly desirable to provide a limited degree of flexibility or so-called "action" between the wheel and axle assembly but without a feeling of looseness between the parts, or undue wear between the assembled parts, thus to afford a controlled degree of motion, and skaters may adjust the sensitivity by adjusting the action screw and nut relative the included cushioning blocks.

The resilient socket for the end of the action strut arms greatly increases this "feel" of the skate but in the past such sockets have been subject excessive wear under constant energetic skating action as by pinching the edges of a normal cup-like cushion against the edges of its mounting recess. It is desirable to reduce such wear in both the front and rear truck assemblies but, generally speaking, the front truck assembly is subject to more vigorous "action". In gracefully performing certain motions or steps, the flexibility should be accomplished without a loose feeling and without undue wear or strain on the assembly. The cushion blocks on the action screw and platform accomplish much of this confined flexibility but the action strut arm is subjected to resultant movements not only laterally but fore and aft. The principal resultant action of the strut arm occurs as the front truck assembly is rearwardly and upwardly urged under certain energetic movement, the strut arm of the front truck assembly will tend toward clockwise movement and with some upward movement. In doing so, the forward enlarged portion of the cushion socket member 80 will resiliently yield and reduce pinching action on the rear portion of the cushion. This is permitted by the unconfined inclined portion 82 being free to "give" under the movement of the action strut and then recover as the truck assembly reverts to or toward normal skating position. While wear of the cushion member is greatly reduced, replacement thereof is simplified since it is trapped in position by the strut arm which may be removed with the truck assembly for this purpose, and the downwardly enlarging internal shaping of the recess 38 or 40 permits ready removal of the cushion and equally ready assembly of a replacement.

I claim:

1. A roller skate comprising a unitary sole plate having toe and heel portions joined by an instep portion, a top surface for receiving a shoe and a bottom surface for receiving truck assemblies; a front wheel truck assembly at the toe portion of the sole plate bottom surface and a rear wheel truck assembly at the heel portion of the sole plate bottom surface, each truck assembly including a cushioned action screw connected to the sole plate and extending through a platform from which a strut arm inclines upwardly toward the adjacent end of the sole plate; said sole plate bottom surface having a pair of downwardly open recesses, one adjacent the front of the toe portion and the other adjacent the rear of the heel portion, with each recess having an upper closed end and a lower end opening defined by downwardly relatively diverging internal wall surfaces of the recess which are substantially free of any undercutting relative to the upper closed end and with a portion of the internal wall surface of each recess toward the adjacent end of the sole plate extending downwardly below the remaining diverging internal wall surface and in continued divergence relative thereto and more remotely spaced from the associated strut arm; and a cushion element mounted in each recess and conforming to the shaping of the internal wall surfaces thereof and having a socket therein similarly inclined with respect to the associated strut arm and of complementary shape for receiving the free end of the associated strut arm; and with the socket opening disposed vertically above the terminal end of the downwardly extending internal wall surface of the recess leaving therebetween additional thickness of the cushion material which is inclined downwardly from the socket opening and away from confining engagement with the associated strut for permissive expansion and recovery of the inclined and unconfined cushion material under active movements of the strut arm.

2. A roller skate as claimed in claim 1, wherein the internal wall surface of each recess toward the adjacent end of the sole plate is generally vertical with respect to the horizontal plane of the sole plate to present the increased thickness of the cushion element intermediate the socket and the vertical wall surface of the recess.

3. A roller skate as claimed in claim 1, wherein the recess is elongate along the axis of the sole plate.

4. A roller skate as claimed in claim 1, wherein the upper surface of the sole plate is provided with upwardly open hexagonal recesses receiving cushion-fastener elements, as a nut or fastener head, for securing the action screws against rotation.

5. A sole plate for a roller skate of the type including front and rear wheel truck assemblies at the heel and toe portions and each with a cushioned action screw and an upwardly inclined strut arm; said sole plate comprising: a molded unitary plate portion with depending heel and toe embossments, each embossment having a downwardly open recess having a closed upper end and a lower end opening defined by downwardly relatively diverging internal wall surfaces without undercutting thereof relative to the upper closed end, the wall surface of each recess nearest the adjacent end of the sole plate being at least generally vertical with respect to the horizontal plane of the sole plate and an opposite wall surface of each recess being inclined generally symmetrically with respect to the central axis of an associated inclined strut arm; and a cushion element mounted in each recess and conforming to the internal shaping of the wall surfaces and having a socket therein for receiving an inclined free end of an associated strut arm and resiliently reacting to movements of the strut arm during skating operations; each said cushion element socket having generally parallel internal surface portions inclined for mating with said inclined free end of an associated strut arm, and providing space for additional thickness of the included cushion element between the strut arm socket and the vertical wall surface of the associated recess; a portion of the internal wall surface of each recess toward the adjacent end of the sole plate extending downwardly with respect to the remaining recess internal wall with the additional thickness of the included cushion element exposed to the open end of the recess to extend downwardly from the adjacent surface of the strut arm socket to the downwardly wall surface portion of the cushion-receiving recess.

6. A sole plate as claimed in claim 5, wherein the upper surface of the sole plate is provided with upwardly open out-of-round recesses at the heel and toe portions for fixedly receiving similarly shaped fastener elements, as a nut or fastener head, securing the action screws against rotation.

7. A sole plate as claimed in claim 5 and further including a recessed upper surface defined by an upstanding peripheral wall and a plurality of generally diagonally disposed reinforcing ribs extending between inner surfaces of the upstanding peripheral wall.

8. A sole plate as claimed in claim 7 wherein the upstanding peripheral wall is contoured to define heel, instep and toe portions for attachment of a shoe to the sole plate and further including fastener accommodating apertures extending through the sole plate recessed upper surface for accommodating fasteners for attachment of a shoe to said sole plate upper surface.

* * * * *